United States Patent [19]

Mainville

[11] 4,364,425

[45] Dec. 21, 1982

[54] TOBACCO STORAGE BAG

[75] Inventor: Jacques Mainville, Kirkland, Canada

[73] Assignee: Benson & Hedges (Canada) Inc., Montreal, Canada

[21] Appl. No.: 206,657

[22] Filed: Nov. 13, 1980

[30] Foreign Application Priority Data

Nov. 15, 1979 [CA] Canada ..... 339960

[51] Int. Cl.[3] ..... B65D 33/14

[52] U.S. Cl. ..... 150/51; 150/1

[58] Field of Search ..... 150/1, 51, 49; 222/180, 222/105, 173; 248/98, 97

[56] References Cited

U.S. PATENT DOCUMENTS

| | | | |
|---|---|---|---|
| 3,286,752 | 11/1966 | Duryee | 150/49 |
| 3,614,041 | 10/1971 | Koger | 248/97 |
| 3,638,699 | 2/1972 | Hillinger | 222/105 X |
| 4,211,266 | 7/1980 | Massey | 150/1 |

FOREIGN PATENT DOCUMENTS

| | | |
|---|---|---|
| 79824 | 3/1903 | Canada . |
| 103640 | 2/1907 | Canada . |
| 649423 | 9/1962 | Canada . |
| 706246 | 3/1965 | Canada . |
| 800454 | 12/1968 | Canada . |

*Primary Examiner*—Donald F. Norton

*Attorney, Agent, or Firm*—Stevens, Davis, Miller & Mosher

[57] ABSTRACT

An apparatus for the storage of cut tobacco is disclosed. The apparatus comprises a mobile structure which supports a bag having openings at the top and bottom for loading and unloading. At least the bottom opening of the bag is closeable. The bag is made of a material inert to tobacco which is both flexible and moisture retaining and having surface frictional characteristics such that a bridging effect is created within the stored tobacco within the opposing inner surfaces of the bag along its length thereby reducing pressure on the tobacco near the bottom of the bag.

13 Claims, 7 Drawing Figures

TOBACCO STORAGE BAG

This invention relates to a mobile tobacco storage means for cut tobacco.

In the prior art, a number of devices have been used for temporary storage of cut tobacco in factories which manufacture cigarettes and the like. One such device, sometimes called a tote-skip, is made of fireboard or aluminum and holds about 40 or 50 pounds of cut tobacco. Certain larger specially extruded aluminum containers have also been used which store up to 120 pounds of tobacco. Finally, large silos have been used which store up to 20,000 to 60,000 pounds of tobacco.

It is an object of the present invention to provide a storage means which will hold about 400 to 600 pounds of cut tobacco.

It is an object of this invention to provide a means of ensuring blend results of cut tobacco.

It is an object of this invention to provide a storage means which may be easily moved about by an operator.

It is an object of this invention to provide a storage means that may be readily replaced if damaged.

It is an object of this invention to provide a storage means having low cost.

It is an object of this invention to provide a storage means which maintains the tobacco at desirable moisture.

It is a primary object of the present invention to provide a storage means in which the tobacco at the bottom of the storage is not subjected to pressures from the upper portions of the storage means, thereby preventing the tobacco from becoming compacted near the bottom of the storage means.

The invention by which the aforementioned objects and others are achieved, consists of a storage means for cut tobacco comprising a bag hung from a mobile supporting structure, said bag having openings at the top and bottom for loading and unloading, at least to the bottom opening being closeable, said bag being made of a material inert to tobacco, flexible and moisture retaining, said material having frictional surface characteristics and said bag having cross sectional dimensions such that a bridging effect is created within the stored tobacco between opposing inner surfaces of the bag along its length thereby reducing pressure in the tobacco near the bottom of the bag. The supporting structure may consist simply of a ring from which the bag is hung on an overhead conveyor or may comprise a skeletal structure mounted on wheels or the like for movement about the floor. For example, the skeletal structure may comprise two rings, one near the top, one near the bottom of the bag, the rings being attached to and supported by three or more rods which terminate at the floor on casters so that it may be rolled about. The bag may be attached to the supporting structure in any convenient manner. The top of the bag may be continuously open or closeable. The bottom of the bag has an opening which may be closed off by any conventional means, for example, string extending through loops which may be drawn tight. It has been found practical to have bags having dimensions of approximately 3 feet in diameter and having a height of 8 feet, however, it will be appreciated by persons skilled in the art that bags having other dimensions will work equally well to obtain the objects of this invention.

While there are a number of advantages as stated above in the object clauses related to this invention, the most surprising and particularly advantageous feature is the "bridging effect" created in the bulk of the tobacco. It is presently understood that this effect is created by the resistance of the inner surface of the bag to movement of the tobacco adjacent to it, combined with the internal frictional cohesion of the cut tobacco to itself and the tendency of particles of cut tobacco to "string" together. This resistance between the tobacco and the bag which supports the tobacco is thought to be caused by a combination of the frictional forces between the tobacco and the inner surfaces of the bag. These frictional forces arise because of the frictional characteristics of the bag material and the tobacco, because of the irregularities in the surface of the bag arising out of its construction and because of irregularities or "ribs" which develop in the flexible bag surface as a result of the complex of forces acting on it when loaded with tobacco. This action is perhaps best described by saying the tobacco "ribs up" against the bag surface. Accordingly, where particles of tobacco against the surface are impeded against movement downward, the particles of tobacco adjacent and slightly above those so impeded are also held up and so on towards the center of the cross section of the bag from the sides thereof to form a kind of arching or "bridging" effect in the particles within the tobacco bulk. The natural tendency of cut tobacco to "string" together by cohesive action is thought to augment this bridging effect. As a result of this effect, the uniform pressure gradient which would normally be expected to increase from the top of the bag to the bottom does not exist and instead pressure buildup is reduced by the "bridging effect". It has been observed that the apparent weight near the bottom of the bag may be as low as 20 pounds although there may be as much as 600 pounds of tobacco stored in the bag.

It will be appreciated by those skilled in the art who have read this specification that the bag material may be fabricated from any number of materials which are inert to tobacco and which demonstrate the characteristics of moisture retention and frictional engagement. It has been found that both polyvinyl chloride and polyethylene demonstrate desirable moisture retention and frictional properties. Further, it has been found that if the bag material is made up of polyamide or polyester mesh overlaid with polyethylene or polyvinyl chloride finish the bag has desirable strength and wear properties. Moreover, the finish over the mesh forms small cavities in the surface of the bag which augment the frictional or supporting effect.

In use, an operator would push an empty bag to a loading area, close the bottom of the bag and load tobacco into the top opening. Once the desired amount of tobacco has been loaded the bag may be moved by an overhead conveyor or may be rolled by means of casters or other means in the supporting frame to various locations in the plant for storage or for unloading in subsequent process operations. When it is desired to unload an amount of tobacco from the storage bag, the operator simply releases the tying means at the bottom of the bag and allows the desired amount of tobacco to fall out. When the desired amount of tobacco has been unloaded, the bag may again be reclosed and returned to storage, or moved on to some other processing operation. Blend results may be ensured by weighing each bag of cut tobacco to be blended during the unloading operation to determine precisely the weight of tobacco unloaded into the blend.

While the foregoing has been a general description of the invention and its attributes, the following is a detailed description of the best embodiment of the invention known at the present time. In the figures which represent the preferred embodiments:

The figures, the bag is generally represented by the numeral 1, an upper ring is indicated by the number 2, a lower ring is indicated by the number 3, supporting rods are indicated by the number 4, casters are indicated as 5, lifting hooks for the supporting structure and bag for mounting on an overhead conveyor are indicated as 6, a cord for fastening the upper portion of the bag about the upper ring is indicated as 7, an opening of the bag at the top is indicated as 8, a fastening cord at the bottom of the bag is indicated as 9, a clamp lock which secures the fastening cord is indicated as 10.

In the preferred embodiments, the material for the bag is polyvinylchloride, the diameter of the lower ring is 37¼", the diameter of the upper ring is 38½" and the distance between the upper and lower rings is 97½". The casters are 5" in diameter. The rods and the rings of the supporting structure are fabricated from one size of steel tubing, preferably 1¼" O.D.×1" I.D.

Figure 1:
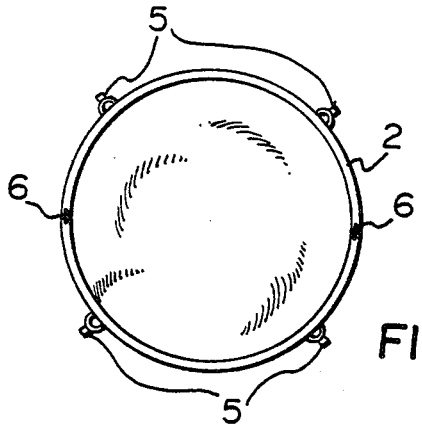
FIG. 1 is a plan view of the preferred embodiment of this invention.
Figure 2:
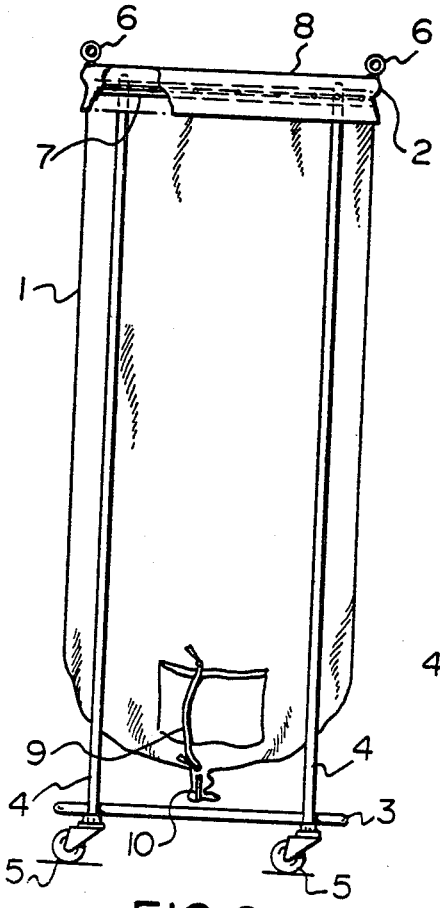
FIG. 2 is an elevation view of the preferred embodiment of this invention.
Figure 3:
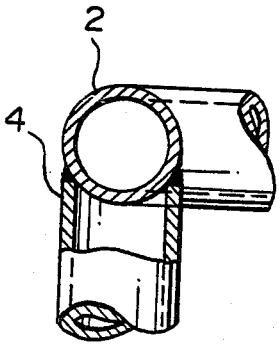
FIG. 3 is a sectional view of the manner in which the top ring is joined to the supporting rods.

FIG. 3 illustrates the manner in which the upper ring may be welded to the supporting rods.

Figure 4:
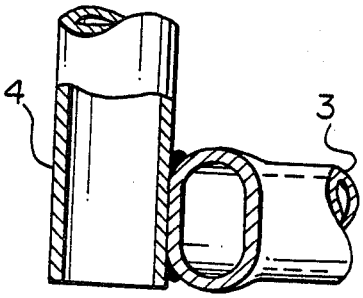
FIG. 4 is a sectional view of the manner in which the lower ring is joined to the supporting rods.

FIG. 4 illustrates the manner in which the lower ring may be welded to the supporting rods. In the area of the weld, the ring is flattened to increase the weld area. Once the supporting structure has been fabricated the bag may be fastened over the upper ring by means of cord 7 and hung between the supporting rods 4.

Figure 6:
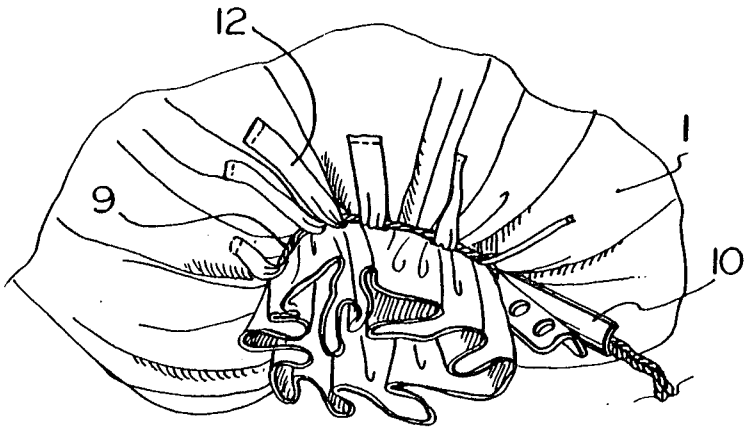
FIG. 6 shows a picture of the bottom of the bag and the closure mechanism in the closed position.

As shown in FIG. 6, closure of the bag is effected by cord 9 which is inserted through loops 12 which are stitched to the sides of the bag 1. The clamp locking mechanism 10 is of conventional construction and like that used in the Post Office and holds the cord at any desired position by means of frictional engagement.

Figure 7:
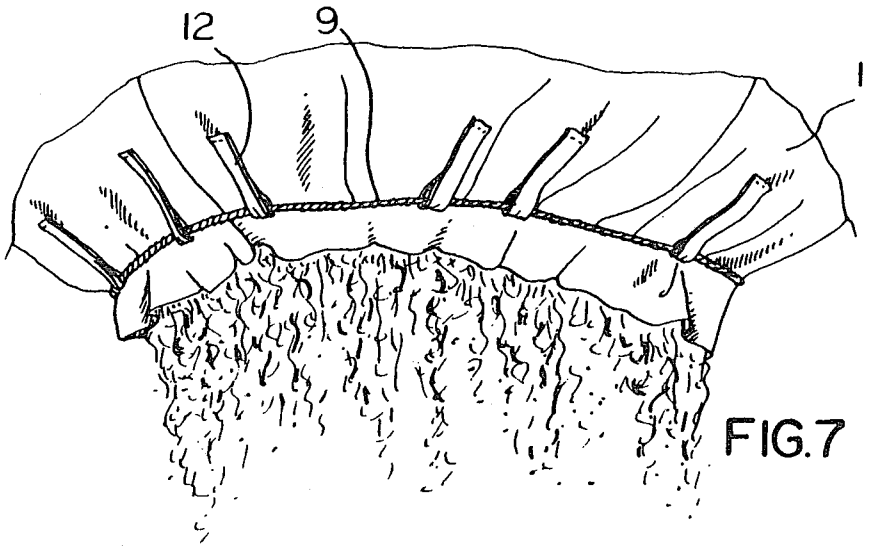
FIG. 7 shows a picture of the bottom of the bag with the closure mechanism in the open position so as to allow the bag to discharge.
Figure 5:
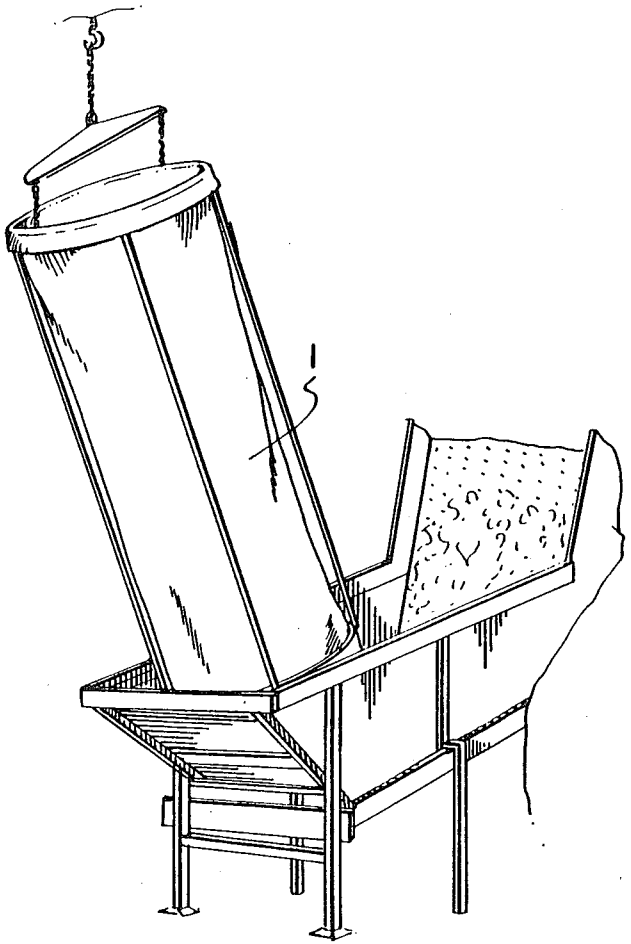
FIG. 5 shows a picture of the preferred embodiment of this invention discharging its tobacco into a feeder mechanism.

FIG. 7 illustrates the bag with the cord and the bottom opening in the open position with tobacco being discharged.

It will be understood that modifications and variations may be effected to adapt the foregoing apparatus for the expediencies for particular applications without departing from the scope of the novel concepts of this invention.

I claim:

1. An apparatus for the storage of cut tobacco comprising a bag hung from a mobile supporting structure, the bag material comprising a mesh overlaid with a plastic finish, said bag having openings at the top and bottom for loading and unloading, at least the bottom opening being closeable, said bag being made of a material inert to tobacco, flexible and moisture retaining, said material having surface frictional characteristics and said bag having cross sectional dimensions such that a bridging effect is created within the stored tobacco between opposing inner surfaces of the bag along its length thereby reducing pressure in the tobacco near the bottom of the bag.

2. The apparatus of claim 1 in which the bag material is a flexible plastic film.

3. The apparatus of claim 1 where the plastic finish is polyvinylchloride.

4. The apparatus of claim 3 where the plastic finish is polyethylene.

5. The apparatus of claim 1 in which the mesh is a polyamide mesh.

6. The apparatus of claim 1 in which the mesh is a polyester mesh.

7. The apparatus of claim 1 in which the supporting structure comprises an upper annular member and a lower annular member connected by a plurality of vertical members.

8. The apparatus of claim 7 in which at least some of the vertical members are mounted on means which facilitate the movement of the apparatus over a floor.

9. The apparatus of claim 8 in which the supporting structure consists of an upper ring and lower ring affixed to a plurality of vertical rods mounted on casters.

10. The apparatus of claim 7 or 8 in which the bag is attached to and hung from the upper annular member 11. The apparatus of claim 1 in which the supporting structure is suspended from an overhead mobile carriage.

12. An apparatus for the storage of cut tobacco comprising an elongated bag hung lengthwise from a supporting skeletal structure, said structure being adapted to be hung from an overhead mobile carriage and being further adapted to roll on a floor, said bag being made from a mesh overlaid with a plastic finish, and having openings at the top and bottom for loading and unloading, at least the bottom opening being closeable, said bag having a cross sectional dimension less than 10 feet.

13. The apparatus of claim 12 where the cross sectional dimension is less than 5 feet.

* * * * *